United States Patent [19]

Niekamp et al.

[11] Patent Number: 4,888,060

[45] Date of Patent: Dec. 19, 1989

[54] ENRICHMENT OF FRUCTOSE SYRUPS

[75] Inventors: Carl W. Niekamp, Forsyth; Martin Seidman, Decatur, both of Ill.

[73] Assignee: A. E. Staley Manufacturing Company, Decatur, Ill.

[21] Appl. No.: 11,417

[22] Filed: Feb. 3, 1987

Related U.S. Application Data

[63] Continuation-in-part of Ser. No. 747,622, Jun. 21, 1985, abandoned.

[51] Int. Cl.[4] ..... C13F 1/02

[52] U.S. Cl. ..... 127/60; 127/58

[58] Field of Search ..... 127/60, 58

[56] References Cited

U.S. PATENT DOCUMENTS

| | | | |
|---|---|---|---|
| 3,257,665 | 6/1966 | Idaszak | 127/60 |
| 3,291,484 | 11/1965 | Smythe et al. | 127/60 |
| 3,547,696 | 12/1970 | Mueller | 127/60 |
| 3,592,688 | 7/1971 | Dean et al. | 127/60 |
| 3,704,168 | 11/1972 | Hara et al. | 127/60 |
| 3,748,175 | 7/1973 | Kawamura et al. | 127/60 |
| 3,981,739 | 9/1976 | Dmitrovsky et al. | 127/60 |
| 4,297,146 | 10/1981 | Mise et al. | 127/60 |

FOREIGN PATENT DOCUMENTS

| | | | |
|---|---|---|---|
| 48-146 | 8/1973 | Japan | 127/60 |

OTHER PUBLICATIONS

Leopold, A Translated Copy of Japanese Patent NS 48146175, filed 8/31/1973, 1975.

CRC Handbook of Chemistry and Physics, 61st Ed., 1980, pp. D-227 and D-239.

*Primary Examiner*—John Doll

*Assistant Examiner*—Chung K. Pak

*Attorney, Agent, or Firm*—Michael F. Campbell; J. Daniel Wood

[57] ABSTRACT

A process for manufacturing an enriched fructose syrup, which is characterized in that dextrose is crystallized from a syrup containing fructose and dextrose and then an alcohol is added to enhance separation of the dextrose crystals from the mother liquor.

Process can be adjusted to yield dextrose monohydrate, anhydrous alpha dextrose or a 40 percent fructose crystalline product in addition to an enriched fructose syrup.

22 Claims, No Drawings

ENRICHMENT OF FRUCTOSE SYRUPS

This application is a continuation-in-part of U.S. Ser. No. 747,622, filed June 21, 1985, now abandoned.

FIELD OF THE INVENTION

The present invention relates generally to the manufacture of an enriched fructose syrup, and more particularly, it relates to the manufacture of a syrup having more than 55 percent fructose on a dry solids basis.

BACKGROUND OF THE INVENTION

The manufacture of fructose containing syrup has been known for many years and, generally, such manufacture has been accomplished in two principal ways. In accordance with one way, a sucrose solution is hydrolyzed to prepare an invert sugar syrup. Another way is to treat dextrose with an isomerase or alkali so as to convert glucose to fructose by an enzyme or isomerization process. Such processes, however, provide syrups usually having less than about 50 percent fructose. It is known to take these fructose containing syrups and increase the level of fructose by a chromatographic fractionation process. Such process is widely used in the industry to provide syrups containing 55 percent, or greater, fructose on a dry solids basis (d.s.b.).

The chromatographic process for increasing the level of fructose provided by hydrolysis of sucrose or by isomerization of dextrose, involves the evaporation of a fructose containing syrup to about 60 percent d.s. The syrup is subjected to a fractionation step, after dilution with water, in an absorption column which provides a raffinate which must be handled. The product must be carbon refined, and ion exchange refined, whereupon it is subjected to a final evaporation to a dry solids of 77 percent. The end product has about 55 percent or more fructose, d.s.b. However, this chromatographic process has certain disadvantages and it would be desirable to avoid the fractionation step and the final ion exchange refining step. Further, it would be desirable to avoid the production of raffinate and to minimize the microbiological problems associated with the chromatographic process. It would also be desirable to reduce the cost of the chromatographic process and to limit the energy requirements of such process.

A process for the manufacture of high fructose syrup is disclosed in U.S. Pat. No. 4,395,292 issued July 26, 1983. The process disclosed in this patent involves the use of a molecular exclusion column to remove dextrose and higher saccharides from the syrup. However, this process has the disadvantages which are attendant to the chromatographic process.

U.S. Pat. No. 3,704,168 issued Nov. 28, 1972 is directed to a process for the crystallization of glucose, fructose, or a mixture of glucose and fructose. The patent teaches the formation of a solution in which a mixed sugar is present containing glucose and fructose which is dissolved in a combination medium comprising a liquid polyhydric alcohol, and a liquid monohydric alcohol having a water content of less than 5 percent. The solution is held under supersaturated conditions and a seed crystal is added to effect crystallization. However, this process is costly and does not have the advantages of the present invention.

U.S. Pat. No. 4,371,402 issued Feb. 1, 1983 is directed to a process for preparation of fructose containing solid sugar from a fructose containing liquid sugar by the steps of dehydration, aging and solidification. The process disclosed involves using an azeotropic organic solvent and a dehydration step utilizing a stream of gas. The process is expensive and not of great advantage in the commercial production of high fructose containing syrups.

British Pat. No. 2,087,400 issued May 31, 1984, is directed to a process for the production of a syrup having a high fructose concentration. In accordance with the teachings of this application, a glucose syrup is mixed with a crystallization product containing dissolved fructose and glucose, as well as glucose crystals, to form a homogeneous solution. The solution is then isomerized and evaporated whereupon it is seeded with glucose crystals. The seeded mixture is cooled to crystallize glucose, which is recycled and mixed with the glucose syrup. However, this process does not provide good results in commercial practice.

Various processes are known to manufacture dextrose monohydrate and anhydrous alpha dextrose crystals, and these are items of commerce. However, such processes have not provided high fructose containing solutions so that a high fructose syrup can be provided along with a dextrose monohydrate or anhydrous alpha dextrose by-products. Prior processes for making anhydrous alpha dextrose have generally required the absence of impurities to obtain effective results.

It is a principal object of this invention to provide an improved process for enriching the fructose content of a fructose containing syrup.

A further object of the invention is an improved method of manufacturing high fructose syrup having at least about 55 percent or more fructose d.s.b. while, at the same time, providing dextrose monohydrate or anhydrous alpha dextrose.

A still further object of this invention is the provision of a more efficient, lower cost manufacturing process for high fructose syrups.

Other objects and advantages of the invention will become apparent by reference to the following description.

Throughout the specification and claims all ratios and percentages are stated on a weight basis, temperatures are in degrees Celsius and pressures are in KPascals over (or under) ambient unless otherwise indicated.

SUMMARY OF THE INVENTION

In one aspect the present invention is a process for manufacturing an enriched fructose syrup comprising the steps of:

(a) providing a fructose containing feed syrup having a dry solids content between about 75 and 89 percent with the dry solids including at least 94 percent monosaccharides, on a dry solids basis, said monosaccharides being primarily composed of dextrose and fructose:

(b) establishing a feed syrup temperature appropriate for crystallization of the desired form of dextrose crystals;

(c) seeding said feed syrup with a dextrose seed crystal;

(d) allowing said feed syrup to crystallize for at least about 8 hours to form a massecuite comprising dextrose crystals and mother liquor;

(e) mixing an alcohol with said massecuite in an amount sufficient to enhance separation of said crystals, said alcohol optionally comprising up to about 30 percent water by weight of said alcohol;

(f) separating said dextrose crystals from said mother liquor to yield a crystalline product; and (g) removing said alcohol from said mother liquor to yield an enriched fructose syrup in which the fructose content has been increased by at least 10 percent relative to the original fructose content of the initial fructose containing feed syrup.

In other embodiments described in detail below, the invention provides a process for producing dextrose monohydrate, anhydrous alpha dextrose or a solid product containing at least 40 percent fructose.

In an especially advantageous aspect, this invention is a process for producing an enriched fructose syrup containing at least about 55% or more fructose on a dry solids basis.

DESCRIPTION OF THE INVENTION

The present invention contemplates the manufacture of an enriched fructose syrup, preferably containing about 55 percent fructose, or higher, d.s.b. In accordance with the invention, a feed syrup is prepared or provided having at least 94 percent, d.s.b., monosaccharides, preferably at least about 96, d.s.b., percent monosaccharides, and in which said monosaccharides are primarily or predominantly (e.g., at least about 90, preferably at least about 95 percent) composed of dextrose and fructose. The amount of higher saccharides present should be less than 6 percent, d.s.b. In the feed syrup, fructose will typically constitute between about 35 percent and 50 percent of the monosaccharide content, and dextrose will typically constitute between about 45 percent and 65 percent of the monosaccharide content. The dry solids content of the indicated feed syrup should be between about 75 percent and about 89 percent.

In order to achieve the results of the invention, the dry solids content of the syrup is an important consideration and at dry solids contents higher than about 89 percent, the syrup becomes too viscous so that the rate of dextrose crystallization slows down. At lower dry solid levels, that is below about 75 percent, the desired extent of crystallization of the dextrose does not occur. The best results have been achieved when the dry solids content of the syrup is between about 77 percent and about 81 percent, and preferably about 79 percent for dextrose monohydrate and between about 83 percent and about 87 percent, preferably, about 85 percent, for anhydrous dextrose.

The level of monosaccharides in the syrup is also important for achieving the desired results and the process becomes inefficient at monosaccharide levels below about 94 percent, d.s.b. Present commercial processes for making high monosaccharide content syrups are known and readily provide levels of dextrose and fructose within the above indicated ranges.

The feed syrup which is to be treated can be prepared by isomerization of a dextrose syrup, derived from any starch source, preferably corn starch, or by hydrolysis of a sucrose solution to prepare invert sugar. The processes for isomerizing dextrose syrup and hydrolyzing a sucrose solution are well known in the art, and need not be further described. However, these known processes should be carried out to provide a feed syrup for treatment which has a dry solids level and which comprises monosaccharides, including dextrose and fructose, within the above prescribed ranges. Generally, the syrup provided by these processes will have to be evaporated to provide the dry solids content specified.

The dextrose and fructose containing syrup is then cooled to a temperature selected to provide dextrose monohydrate or anhydrous alpha dextrose crystals. To provide dextrose monohydrate, cooling is effected to between about 15° C. and 24° C., and the syrups seeded, preferably with dextrose monohydrate seed crystals, in accordance with usual seeding practices. To provide anhydrous alpha dextrose, the syrup is cooled to between about 24° C. and about 55° C., preferably between about 26° C. and about 35° C., and the syrup is seeded preferably with anhydrous alpha dextrose seed crystals. Generally, the seed crystals employed will be such that at least about 55 percent of the crystals will pass a 200 mesh screen and said seed crystals will typically be employed at a level corresponding to about 1 percent based upon the weight of the monosaccharides in the syrup. The temperature for crystallization is related to the dry solids content so as to provide a desired viscosity and crystallizing condition. The crystallization should be carried out for more than about 8 hours to provide a massecuite comprising dextrose monohydrate or anhydrous alpha dextrose and a mother liquor. The time required for crystallization is dependent on the nature of the fructose feed syrup and upon the fructose content desired for the finished enriched fructose syrup. In general, the crystallization will be carried out for at least about 8 hours. In those instances where the fructose content of the feed syrup is relatively low (e.g. between about 35 and about 45 percent d.s.b.) and wherein the fructose level desired in the ultimate enriched syrup product is in excess of about 50 percent, d.s.b., the crystallization will generally be conducted for at least about 24 hours. Longer periods of time for crystallization will increase crystal yield but it has been found that times in excess of about 48 hours do not provide substantially increased fructose levels in the mother liquor. Of course, the length of crystallizing times affects the productivity of the process which, in turn, affects the size of crystallizing tanks and capital investment which are required for practical commercial practice. In any event, the crystallization should be carried out until the mother liquor has a fructose content which is at least 10 percent higher than that of the starting feed syrup. Thus, for example, when the starting feed syrup has an initial fructose content of about 40 percent, d.s.b., the crystallization will be conducted until the mother liquor has a fructose content of at least about 44 percent, d.s.b. In an especially preferred embodiment, the crystallization will be conducted until the mother liquor has a fructose content of at least about 55 percent, d.s.b., regardless of the initial fructose content of the starting feed syrup material.

After crystallization, the massecuite, which is relatively viscous and difficult to handle and filter, and which does not permit the ready separation of the crystals from the mother liquor, is mixed with an alcohol which can optionally contain up to 30 percent water (preferably from about 5 percent to about 15 percent water) to provide substantial reduction in viscosity. Preferably, of course, the alcohol will be ethanol but may comprise a mixture of ethanol and methanol and may include denaturants such as ethyl acetate, etc. The amount of alcohol relates to massecuite or syrup containing crystals and will be in the range of about 0.4 to 2.0 per part of massecuite, preferably in the range of about 0.5 to 1.5 per part of massecuite. The mixture is then filtered or centrifuged to provide a cake primarily including dextrose crystals and a mother liquor having an enriched fructose content (preferably more than 55 percent fructose on a dry solids basis). The dextrose crystals may be recycled back to the preparation of isomerized glucose and, of course, the dextrose is an item of commerce. The dextrose crystals can be air or oven dried to provide the anhydrous alpha dextrose or dextrose monohydrate.

In another aspect of this invention, the separation process may be modified to yield a crystalline dextrose product that contains at least about 40 percent, d.s.b., fructose. The ratio of alcohol to massecuite is increased to about 2:1 on a weight basis to cause incorporation of fructose in the crystalline dextrose product.

In this invention, alcohol is added to the crystallized syrup, the massecuite, to reduce viscosity and to enhance the ease of separation of dextrose crystals from the mother liquor. The alcohol is not used in the crystallization step.

The mother liquor is then distilled to remove the alcohol and it has been found that the presence of the monosaccharides in the mother liquor facilitates effective distillation of the alcohol. In order to protect the product and provide the best product quality, vacuum distillation is performed and the distillation should be carried out at a vacuum of at least −20 KPa so that the temperature of the mother liquor is maintained below about 80° C. during said distillation. The recovered syrup, as before indicated, has an increased fructose content relative to that of the initial feed syrup and preferably comprised more than about 55 percent of fructose on a dry solids basis. If desired, the recovered syrup can comprise up to about 70 percent fructose on a dry solids basis.

The temperature conditions and seed in the crystallization step determine whether anhydrous alpha dextrose crystals are formed or whether dextrose monohydrate crystals are formed. As indicated, the dextrose monohydrate crystals are formed in the temperature range of 15° C. to 24° C., whereas the anhydrous alpha dextrose crystals are formed at a temperature between about 24° C. and about 55° C., preferably between about 26° C. and 35° C.

The dextrose from the process is harvested as crystalline product or can be desirably recycled back to a process step for the preparation of the isomerized glucose so that the percentage of monosaccharides in the resulting isomerized product is raised. Generally, it has been found that this recycling can be used to raise the monosaccharide content of the dry solids in the isomerized glucose by 1 percent to 2 percent and to thereby make the resulting overall process relatively more efficient.

The hydrolysis of a sucrose solution also gives a highly desirable product for the practice of the invention. More particularly, the syrup which is provided has a very low level of oligosaccharides and is free from maltose, which serves as a crystallization depressant.

EXAMPLE 1

A dextrose syrup is used, which has been isomerized, and which provides a fructose containing syrup as follows:

44.5% fructose d.s.b.
49.9% dextrose d.s.b.
5.6% oligosaccharides d.s.b.
76.2% dry solids The isomerized syrup is cooled to 17–18° C. and seeded with dextrose monohydrate crystals having more than 80 percent of the crystals passing through a 200 mesh screen. The seed crystals are added at a level of 1 percent of the sugars present in the syrup. The seeded syrup is stirred for 40 hours to develop dextrose monohydride crystals and an enriched mother liquor comprising 56 percent fructose d.s.b.

3A alcohol comprising 5 percent water is added in at a level of 0.6 parts alcohol to 1 part massecuite, on a weight basis. After mixing, the crystallized solution is filtered leaving a cake comprising 77.2 percent dextrose, 19.1 percent fructose, and 3.7 percent oligosaccharides. The cake is oven dried for 16 hours at a temperature of about 50° C. The dextrose is in the form of dextrose monohydrate crystals.

The mother liquor, recovered as a filtrate, permits 85 percent recovery of fructose and is evaporated under vacuum conditions.

The temperature of the product does not exceed 80° C. during evaporation and the vacuum is at a level of −20 KPa. After evaporation, the sugar comprises 58.8 percent fructose, 34.4 percent dextrose and 6.8 percent oligosaccharides.

EXAMPLE 2

In accordance with this Example, the procedure of Example 1 is followed except that the ratio of the alcohol to massecuite is changed to be 2:1 on a weight basis. The cake comprises 59 percent dextrose, 40 percent fructose and 1 percent of oligosaccharides to yield a dry 40 percent fructose product. The mother liquor comprises 60.8 percent fructose, 33.7 percent dextrose and 5.5 percent oligosaccharides. The percent recovery of fructose in the mother liquor is 29 percent.

EXAMPLE 3

The procedure for preparing the massecuite with added aqueous alcohol is conducted in accordance with Example 1, but instead of filtering the massecuite and alcohol mixture, the product is centrifuged and washed twice with two rinses of an aqueous alcohol solution (89 percent by weight of 3A alcohol and eleven percent by weight of water). The amount of each rinse is equal to ten percent of the original massecuite weight. This procedure provides a cake comprising 98.1 percent dextrose, 0.7 percent fructose, and 1.2 percent oligosaccharides. The centrifugate comprises 56.2 percent fructose, 35.6 percent dextrose and 8.2 percent oligosaccharides.

EXAMPLE 4

In accord with this example a commercially available dextrose syrup sold under the trademark STALEY-DEX 95, and having a dextrose level of 96 percent and an oligosaccharide level of 4 percent, is diluted to 28 percent dry solids basis, and placed in a tank. In the tank is also placed dextrose monohydrate recovered from the process of the invention to provide saccharides at a level of 33 percent on a dry solids basis. This effects an increase of 1 percent in the amount of monosaccharides. The mixture is ion exchanged and evaporated to a dry solids level of 45 percent, in accordance with normal commercial practice, and isomerized with an isomerizing enzyme. The product of the isomerization is treated with carbon and ion exchanged, again in accordance with commercial practice. The resulting syrup is then evaporated to 79 percent dry solids. This material is treated in accordance with Example 1 and the recovered dextrose monohydrate is returned, in part, to the tank for mixing with the dextrose syrup. As before indicated, it is highly advantageous to utilize this dextrose to increase the percentage of monosaccharides in the system giving an improved result. In the use, where a dry monohydrate dextrose is desired as secondary product, the dextrose crystals are air dried to a 91 percent dry solids level.

Evaporated, isomerized dextrose solution may be blended with the output of this process of the invention to achieve a 55 percent level of fructose. Evaporation may be provided to raise the level of saccharides desired to provide the end product syrup which is usually 77 percent.

EXAMPLE 5

In accord with this Example, a fructose containing syrup is derived from a hydrolyzed sucrose solution. Invert sugar is prepared by preparing a sucrose solution comprising 20 percent sucrose d.s.b. A strong acid cation exchange resin is added at a level of 0.2 grams (wet basis) per gram of sucrose to provide about 80 m.e.q. hydrogen (plus) per mole of sucrose. The resin used in accord with this example was DOWEX™ 50W-X1-100. The mixture was heated to 55° C. and, at temperature, was stirred for 24 hours to provide an invert sugar solution.

On a dry basis, the invert sugar comprised 49.3 percent fructose, 49.8 percent dextrose and 0.9 percent oligosaccharides. The level of oligosaccharides is low relative to isomerized dextrose syrup and no maltose is present. The invert sugar solution having a solids content of 78.9 percent was cooled to 18° C. and at the end of 24 hours on a dry basis, the liquid phase on a dry solids basis comprised 69.5 percent fructose, 30.0 percent dextrose, and 0.5 percent oligosaccharides. At the end of 48 hours, the invert sugar solution, on a dry solids basis, comprised 70.4 percent fructose, 29.1 percent dextrose, and 0.5 percent oligosaccharides. After 7 days of crystallization, the mother liquor comprised, on a dry basis, 70.9 percent fructose, 28.5 percent dextrose and 0.6 percent oligosaccharides.

To the massecuite was added 0.6 parts of 95 percent 3A alcohol to 1 part of massecuite for purposes of separation. The alcohol contained 5 percent water. The percentage of methanol was 5 percent of the alcohol on a volume basis. The mixture was filtered to provide a cake and mother liquor.

On the other hand, when an isomerized corn syrup comprising about 42 percent fructose, commercially available as ISOSWEET™ 100 was used as the starting material, the material comprised 43.8 percent fructose, 53.2 percent dextrose, and 3.0 percent oligosaccharides. The isomerized corn syrup had a dry solids of 78.9 percent, as in the case of the invert sugar solution, and was cooled to 18° C., to which was added 1 percent d.s.b. of a powdered dextrose monohydrate available in the market place as STALEYDEX™ 111.

After 24 hours, the mother liquor comprised, on a dry solids basis, 61.0 percent fructose, 34.3 percent dextrose, and 4.7 percent oligosaccharides. After 48 hours of crystallization, the mother liquor comprised, on a dry basis, 62.5 percent fructose, 32.5 percent dextrose, and 5.0 percent oligosaccharides. At the end of 7 days, the mother liquor, on a dry basis, comprised 63.5 percent fructose, 31.5 percent dextrose, and 5.0 percent oligosaccharides.

Separation was effected as was accomplished with the massecuite of invert sugar solution and alcohol.

From the foregoing it will be seen that there is not a very substantial further increase in fructose levels after 24 hours and there is less increase in yield after 48 hours crystallization. Accordingly, the crystallization will normally be limited to a crystallization period of less than 48 hours. It should also be noted that the invert sugar solution provided higher levels of fructose which is believed to be occasioned by the lower level of oligosaccharides and possibly maltose in the solution.

EXAMPLE 6

In accord with this example, crystallization was carried out under conditions which will form anhydrous alpha dextrose crystals. A high fructose corn syrup, commercially available as ISOSWEET™ 100 was evaporated to provide a syrup at 87 percent dry solids basis. On the dry solids, 43 percent was fructose and 53 percent was dextrose, with the remainder being oligosaccharides. The syrup comprised 96 percent monosaccharides on a dry solids basis. The isomerized syrup was crystallized at 30° C. for 31 hours and seeded with anhydrous alpha dextrose crystals. The stirring was carried out during crystallization in accordance with usual practices.

After crystallization, a co-solvent was added in the form of 3A alcohol containing 5 percent methanol by volume and including 5 percent water by weight. The co-solvent was added to three different aliquots at three different ratios of co-solvent to massecuite. The addition of the co-solvent substantially reduced the viscosity.

Undiluted mother liquor could not be filtered through a Buchner funnel connected to a flask evacuated by a water aspirator. The three aliquots of diluted massecuite were filterable through the Buchner funnel. The alcohol to massecuite ratio of each aliquot, the filtration times and fructose content of the mother liquor filtrates after stripping of alcohol, are shown in the following table:

TABLE 1

Effect of Ratio of Alcohol to Massecuite on Filtration Time and Fructose Content

| | Ratio of Alcohol: Massecuite (wt:wt) | | |
|---|---|---|---|
| | 0.2 | 0.4 | 0.6 |
| Filtration Time (min) | 4 | 0.5 | 0.5 |
| Fructose Content of Mother Liquor (% d.s.b.) | 56.2 | 56.0 | 54.1 |

The above table shows that using an alcohol:massecuite ratio of 0.6 caused a substantial reduction of fructose content, i.e., a substantial increase in dextrose content, in the mother liquor as compared with an alcohol:massecuite ratio of 0.4, but provided no improvement in filtration time. Accordingly, an alcohol to massecuite ratio of from about 0.2 to about 0.6 is particularly preferred.

Thus, anhydrous alpha dextrose is provided which can be sold as an item of commerce.

The process of the invention provides a simple and efficient way for increasing the fructose content in a fructose containing syrup which has many advantages over the use of the chromatographic techniques now employed. The raffinate stream is omitted and valuable by-products are provided for sale.

The various features of the invention which are believed to be new are set forth in the following claims.

What is claimed is:

1. A process for manufacturing an enriched fructose syrup comprising the steps of:

(a) providing a fructose containing feed syrup having a dry solids content between about 75 and 89 percent, the dry solids of said feed syrup comprising at least 94 percent monosaccharides on a dry solids basis and said monosaccharides being primarily composed of dextrose and fructose;

(b) establishing a feed syrup temperature of from about 15° C. to about 55° C.;

(c) seeding said feed syrup with a dextrose seed crystal;

(d) allowing said feed syrup to crystallize for at least about 8 hours at a crystallization temperature of from about 15° C. to about 55° C. to form a massecuite comprising dextrose crystals and mother liquor;

(e) adding an alcohol to, and mixing the alcohol with, said massecuite in an amount sufficient to enhance separation of said crystals, said alcohol comprising up to about 30 percent water by weight of said alcohol;

(f) separating said dextrose crystals from said mother liquor to yield a crystalline product; and (g) removing said alcohol from said mother liquor to yield an enriched fructose syrup in which the fructose content has been increased by at least 10 percent relative to the original fructose content of the initial fructose containing feed syrup.

2. The process of claim 1, wherein the crystallization temperature is maintained between about 15 to about 24° C. to yield dextrose monohydrate.

3. The process of claim 1, wherein said fructose containing feed syrup has a dry solids content between about 77 percent to about 81 percent.

4. The process of claim 1, wherein the crystallization temperature is maintained between about 24 to about 55° C. to yield anhydrous alpha dextrose.

5. The process of claim 4, wherein said syrup temperature is maintained at between about 26 to about 35° C.

6. The process of claim 4, wherein said fructose containing feed syrup has a dry solids content between about 83 percent to about 87 percent.

7. The process of claim 1, wherein said enriched fructose syrup contains at least about 55 percent or more fructose on a dry solids basis.

8. The process of claim 1, wherein said alcohol is removed from said mother liquor by vacuum distillation.

9. The process of claim 1, wherein said crystalline product contains fructose.

10. The process of claim 9, wherein said crystalline product contains at least about 40 percent fructose on a dry solids basis.

11. The process of claim 1, wherein said crystalline product is dextrose monohydrate.

12. The process of claim 1, wherein said crystalline product is anhydrous alpha dextrose.

13. The process of claim 1, wherein said fructose containing syrup is derived from starch.

14. The process of claim 1, wherein said fructose containing syrup is derived from a sucrose source.

15. The process of claim 1, wherein said alcohol is a mixture of ethanol and methanol.

16. The process of claim 1, wherein said alcohol is ethanol.

17. The process of claim 16, wherein said ethanol contains a denaturant.

18. The process of claim 1, wherein said alcohol contains between about 5 percent to about 15 percent water.

19. The process of claim 1, wherein the ratio of said alcohol to said massecuite is in the range of about 0.4:1.0 to 2.0:1.0.

20. The process of claim 19 wherein the ratio of said alcohol to said massecuite is in the range of about 0.5:1.0 to and 1.5:1.0.

21. The process of claim 1, wherein said feed syrup to is allowed to crystallize for at least 24 hours.

22. The process of claim 1 wherein the ratio by weight of said alcohol to said massecuite is in the range of about 0.2 to about 0.6.

* * * * *